United States Patent [19]

Kozy

[11] 4,424,099

[45] Jan. 3, 1984

[54] PROCESS FOR CONTROL OF COKE OVEN EMISSIONS

[75] Inventor: Michael J. Kozy, Pittsburgh, Pa.

[73] Assignee: Koppers Company, Inc., Pittsburgh, Pa.

[21] Appl. No.: 412,257

[22] Filed: Aug. 27, 1982

Related U.S. Application Data

[62] Division of Ser. No. 340,234, Jan. 18, 1982, Pat. No. 4,360,404.

[51] Int. Cl.[3] ..... C10B 33/00; C10B 41/02; C10B 57/00

[52] U.S. Cl. ..... 201/41; 414/786

[58] Field of Search ..... 202/263; 201/41; 414/209, 211, 212, 786; 266/157-159

[56] References Cited

U.S. PATENT DOCUMENTS

| | | | |
|---|---|---|---|
| 3,746,626 | 7/1973 | Morrison | 202/263 |
| 3,844,901 | 10/1974 | Roe et al. | 202/263 |
| 3,879,267 | 4/1975 | Nashan et al. | 202/263 |
| 3,930,961 | 1/1976 | Sustarsic et al. | 202/263 |
| 3,937,656 | 2/1976 | Pries et al. | 202/263 |
| 3,972,782 | 8/1976 | Patton | 202/263 |
| 4,315,804 | 2/1982 | Renner et al. | 202/263 |

*Primary Examiner*—Bradley Garris

*Attorney, Agent, or Firm*—Thomas F. Shanahan; Daniel J. Long; Herbert J. Zeh, Jr.

[57] ABSTRACT

Enclosure and exhaust apparatus is provided to enhance control and removal of coke-side emissions during a push in the operation of a coke oven battery. The gaseous and entrained particulate emissions are initially confined to a first longitudinally extending containment zone where the emissions are directed, under the influence of its gaseous thermal drive, upwardly and laterally outwardly away from the coke-side face of the battery. The emissions are then transferred, at the peak of the first containment zone, laterally, through a gas expansion throat, into a second longitudinally extending containment zone that is adjacent and parallel to the first containment zone. Contemporaneously with entering the second containment zone, a portion of the emissions is removed therefrom through an exhaust conduit located at the upper reaches or peak portion of the second containment zone. The remainder of the gaseous emissions, not immediately removed, are permitted to expand longitudinally and transversely within the second containment zone while carrying with it entrained particulates that also have not been removed through the exhaust system. Finally, the retained remainder of the gaseous emissions in the second containment zone are removed through the exhaust conduit while permitting those particulates that are heavy enough, to fall, by gravity, to a sloped bottom of the second containment zone and, then, to be discharged to ground at a convenient collection area.

2 Claims, 2 Drawing Figures

PROCESS FOR CONTROL OF COKE OVEN EMISSIONS

This is a division of application Ser. No. 340,234, filed Jan. 18, 1982, now U.S. Pat. No. 4,360,404.

BACKGROUND OF THE INVENTION

1. Field of the Invention

This invention relates to a process and apparatus for controlling undesirable emissions from a coke oven and, in particular, to capturing and controllably removing particulate and gaseous emissions that evolve from hot coke as it is pushed from a coke oven in the operation of a coke battery.

2. Description of the Prior Art

Generally speaking, coke side sheds are available that are reasonably effective in controlling coke emissions during the pushing operation. Few people who are knowledgeable about coke side systems will dispute this fact. The prime factor for their limited use in the steel industry has been the adverse environmental conditions created for the workers underneath the shed. Accordingly, the evolution or development of improved shed designs has been directed more toward enhancing the working conditions inside the shed, rather than the mere emission capture aspect of the operation.

The poor working conditions are a result of particulate fallout which occurs during the pushing of the coke into the quench car. Initial designs of sheds were such that emissions were allowed to rise and expand in essentially an open room without regard to particulate fallout. Although improvements have been made to the design of sheds through the use of deflector plates and expansion chambers, particulate fallout and related problems persist to the point where coke plants are still reluctant to use sheds for emission control.

In order to more fully appreciate the advantages of this invention over previous shed designs, several factors must be examined. First, one must understand the flow characteristics of the emissions in a shed. Once the hot emissions rise in the shed they expand longitudinally as well as laterally and, in particular, vertically, and hover in the peak or apex of the shed until evacuation through the fume main takes place. This means there are gaseous and particulate emissions in areas of the shed that are not aided by a thermal draft or thermal drive to keep the particles suspended in the gas. These areas contribute heavily to the fallout problem due to the fact that there is no longer a flow condition to keep the particles entrained or airborne. The same condition exists in the pushing area of the shed once the push is complete and the quench car begins its travel to the quench station. The thermal draft is minimized and fallout can increase.

Accordingly, it is essential to the shed designer to provide for an expansion chamber that is located at a maximum reasonable distance from or, at least, outside the quench track and bench area. Prior shed designs, most notably those of U.S. Pat. Nos. 3,972,782, 3,937,656 and 3,844,901, employ a flow path restriction that will accelerate the emissions into an expansion zone or the like. However, it should be noted that on each of the foregoing designs the throat section or flow path restriction area is on a horizontal plane or at a 45 degree slope. The significance here is that part of all of the expansion area is over top of the throat section which means that, when the emissions expand longitudinally, fallout is vertical and back on the quench track and bench area.

The present invention comprises a significant improvement over such prior art designs by placing the expansion chamber at a maximum reasonable distance from or, at least, outside the bench area and the quench track or, more particularly, at least as far removed as the outer boundary for the pushed coke. The plane of the throat section which separates the initial containment or entrapment chamber from an adjacent, longitudinally parallel expansion or second containment chamber is on a vertical or substantially vertical plane. This means that any fallout occurring in the expansion zone or chamber cannot fall back into the initial entrapment chamber and thus on the workers.

In order for fallout prevention to occur effectively, the emissions must be conveyed to the expansion chamber with a minimum degree of expansion. Thus, the sloped roof of this invention, which spans the first containment or entrapment chamber, has a dual purpose or function. One is to act as a cover for this portion of the shed and, second, it is a linear directional vane for channeling the emissions away from the bench area before they have a chance to expand. The roof slope is preferably approximately 20 to 50 degrees, depending on the application. In contradistinction, the shed designs of U.S. Pat. Nos. 3,972,782, 3,937,656 and 3,844,901 have roof slopes or curvatures that adversely project both inwardly and outwardly in relation to the battery. Moreover, in U.S. Pat. Nos. 3,972,782 and 3,937,656 a heat shield or baffle plate slopes inwardly directing the emissions back towards the bench area and in U.S. Pat. No. 3,844,901 the emissions are directed to a fume main which is unobstructedly positioned directly over the quench tracks and, thus, establishes the fallout area for particulates directly over an area usually occupied by coke oven workers.

Other factors must also be considered in connection with the location of the fume duct. The location of the fume duct is most important for removing emissions effectively, quickly and economically. The fume duct should be located at the apex or peak of the expansion chamber for greatest removal capabilities. If the fume duct is located as shown in U.S. Pat. No. 3,972,782, the exhaust fan horsepower requirements must be higher to overcome the extra flow resistance due to the numbers of 90 degree turns the gaseous emissions must make to enter the duct. Also, there is added resistance in overcoming the thermal draft of the gases by trying to pull the gases from a higher elevation to a lower elevation.

Another disadvantage of the shed of U.S. Pat. No. 3,972,782, is that, if there are leaks in the roof or siding, the ability to pull the emissions to the exhaust duct would be greatly hampered. The flow path of the gas emissions is of great importance to the shed designer. Thus, in accordance with the present invention, the flow path of the gas emissions does not pass through the fallout or settling chamber. This aspect of the design is beneficial because it eliminates the possibility of reentrainment of fallout particles in the gas stream. This means fewer particulates in the gas stream to the gas cleaning system. By maximizing and controlling the fallout particles in a suitable area, such as a defined fallout chamber, the workload of the gas cleaning system, which is normally a high energy user, is lowered. If the gas cleaning system is a baghouse, this means a lower differential pressure across the bags (HP savings), fewer cleaning cycles per day for the bags and increased bag life. In both the shed designs of U.S. Pat. Nos. 3,972,782 and 3,844,901, the flow path of the gas emissions must pass through the expansion and fallout chamber or chambers.

Another important feature of the present invention is the fallout chamber, which is self-cleaning and does not require a mechanical system to remove the particulate fallout. The fallout chamber allows the particles to slide along the sloped bottom section (50 degrees or greater) and eventually to the ground, across the tracks from the bench area, where routine maintenance is performed regardless of whether a shed exists or not. This feature is important in that there are no appreciable areas for dust build-up in the shed. All sloped areas or sections should be 50 degrees or greater (the minimum recommended chute angle for coke breeze is 50 degrees). Both the shed designs of U.S. Pat. Nos. 3,972,782 and 3,844,901 have areas for dust build-up. The design of U.S. Pat. No. 3,972,782 must mechanically remove fallout from the hopper area and that of U.S. Pat. No. 3,844,901 has a catch basin behind the heat shield-deflector plate for dust build-up.

BRIEF SUMMARY OF THE INVENTION

The present invention utilizes features previously offered in prior designs but in a manner to further minimize particle fallout and to reduce shed maintenance. The shed is comprised of an entrapment chamber, directional sloped roof, throat section, expansion chamber, fume main and fallout chamber.

The flow sequence of the emissions during the pushing operation is as follows. The emissions due to the natural draft caused by the thermal conditions present are driven from the quench car vertically to the sloped roof located over the quench tracks. The emissions upon contact with the sloped roof are directed away from the bench area and toward the expansion chamber. In order to maintain the velocity caused by the thermal drive, the emissions are channeled through a venturi and a throat section located between the entrapment chamber and the expansion chamber. Once the emissions are past the throat section and in the expansion chamber the threat of fallout on the bench is negligable if non-existent. Any fallout at this point occurs behind the sheeted-in fallout chamber which has a sloped bottom to allow the larger particulates to drop harmlessly to the ground. The emissions are contained in the expansion chamber until total evacuation takes place. This whole operation is conducted while the fume main, located at the apex or peak of the upper plenum of the expansion chamber, is continuously drawing away the emissions. The fume main will be tapered to balance the gas velocity along the fume main and to keep the particulates airborne. The inlet openings to the fume main will vary in size along the fume main to create equal suction over the length of the entire shed. The following are significant features of the present invention:

1. The shed roof is utilized to direct the gas emissions away from the bench area.

2. Roof panels are projected outwardly only and nowhere are the emissions channeled back towards the bench area.

3. The expansion area is not over the quench tracks or bench area.

4. No major areas are present for retaining particulate fallout, thus eliminating the need for unnecessary routine maintenance.

5. A self-cleaning fallout chamber is provided. The fallout chamber does not require a mechanical means for removing the controlled fallout from the fallout chamber, although a means for collecting and removing the fallout could be adapted to the system.

6. A vertical throat section separates the entrapment chamber and the expansion chamber. Fallout particles cannot fall from the expansion chamber back into the entrapment chamber after gases lose their required velocity for keeping them entrained or airborne.

7. The baffle plate or partition wall, which makes up the throat section, could be made adjustable for varying the opening.

8. The shed has a gradual flow restriction or venturi leading to the throat section. The partition or baffle and sloped roof gradually restrict the flow to the throat section, thus maintaining gas velocity.

9. The gas flow does not pass through the fallout chamber.

10. The fume main or exahust duct is located at the apex or peak of the shed.

DESCRIPTION OF THE PREFERRED EMBODIMENT

Figure 1:
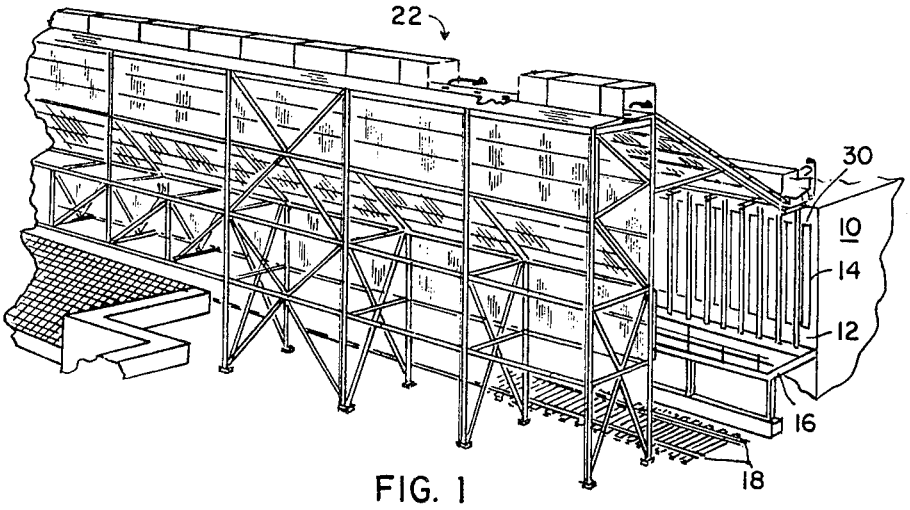
FIG. 1 is a schematic perspective of a coke oven battery and a coke-side emission control shed of this invention.

Illustrated in FIG. 1 is a coke oven battery 10 having a coke-side face 12 and a plurality of coke ovens 14. Residing in front of the coke oven face 12 and extending longitudinally of the coke oven battery 10, at a raised service elevation adjacent and immediately below the coke ovens 14, is a coke-side bench 16. Forwardly or outwardly of bench 16, at ground elevation, are quench car tracks 18 for conveying a quench car or cars to and from a quench station and selected ones of the coke ovens 14. Also at ground elevation, adjacent to but located further outwardly of quench tracks 18 may be a quench wharf 20. All of the foregoing is of conventional design in the construction of a typical coke oven battery. Also shown in FIG. 1 and generally designated 22 is the coke-side emission control shed of the present invention.

Figure 2:
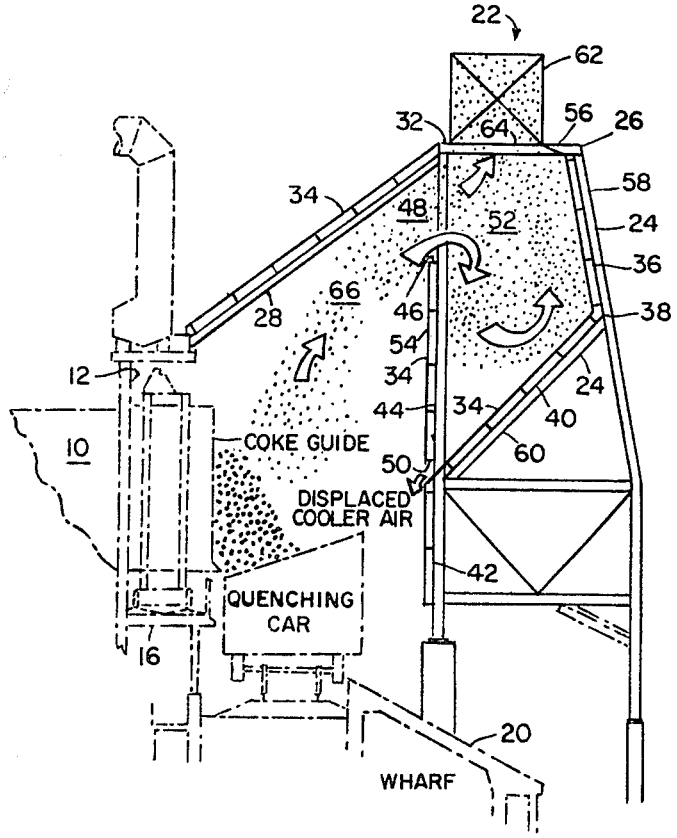
FIG. 2 is a schematic elevation of the coke-side emission control shed of FIG. 1.

As best shown in FIG. 2, coke-side shed 22 comprises a structural skeleton framework 24 that includes an essentially rectangular or polygonal portion 26 that is suitably ground supported forwardly or laterally outwardly of quench tracks 18, when taken with respect to the coke-side face 12 of the battery 10. A further inclined roof enclosure portion 28 of this skeleton framework 24 also extends at a slope of about 30 to 40 degrees from at or near the top 30 (FIG. 1) of the coke oven exit openings, across the bench 16 and quench tracks 18, to join with the apex or peak portion 32 of polygonal skeletal portion 26.

Suitable non-corrosive sheeting 34, of stainless steel or the like, covers the upper side of roof skeletal portion 28, the peak or apex portion 32 of the polygonal skeletal structure 26, a longitudinally extending outside wall portion 36 thereof to a suitable juncture point 38 and a rearwardly or inwardly directed, downwardly inclined wall or bottom enclosure portion 40 extending from juncture point 38 to a location outboard of quench tracks 18. On wall portions 36 and 40, the sheeting is preferably affixed on the interior side of skeleton framework 24 in order to minimize or eliminate dust build-up on these wall portions. As shown, the sheeting 34 may also be employed to provide a skirt enclosure portion 42 extending vertically downwardly from the lowermost terminus of inclined bottom wall portion 40 toward, but preferably ending spaced somewhat above the subjacent ground elevation.

Moreover, a longitudinally extending, essentially vertical partition or baffle wall 44 is formed with sheeting 34, between the coke-side face 12 of the battery and the outer enclosure side wall 36, at a location at least as far removed from the coke-side face as the outer boundary of the receiving zone for the pushed coke. In addition, this partition wall 44 has its upper edge portion 46 supported in spaced relation to the roof enclosure provided by skeletal portion 28 and attached sheeting 34. In this manner there is provided a longitudinal throat 48. Also, partition wall 44 has its lower edge 50 spaced above the longitudinally extending inclined wall 40, extending downwardly from side wall 36, to provide a longitudinal aperature or opening for, as will be understood, prevention of emissions stratification and removal of coke dust or coke breeze particulates that settle out of the coke emissions entrapped in the expansion or containment chamber 52 bounded by the formed wall portions 54, 56, 58 and 60.

Shown atop of expansion chamber 52 is a longitudinally extending fume main or exhaust main 62 having suitable inlet openings (not shown) along side 64 and leading to an emissions cleaning system, such as a baghouse or the like (not shown). From the foregoing, it will also be appreciated that the entrapment or initial containment chamber for the hot, gaseous, coke emissions is appropriately designated at 66.

Accordingly, it will be understood that there is provided an improved enclosure and exhaust apparatus for controlling coke-side emissions during a push in the operations of a coke oven battery. This apparatus includes an exhaust duct 62 extending longitudinally of the battery 10 above top 30 of the coke oven exit openings and having its exhaust inlet means (not shown) located beyond or at least as far removed from the coke-side face 12 of the battery as the normal outer boundary of the receiving zone for the pushed coke prior to its being quenched. Also included is a roof enclosure means 28, 34 bridging the space between the near side of the exhaust duct inlet means and the coke-side face 12 of the battery and an outer enclosure means 56, 58 communicating with the far side of the exhaust duct inlet means and having a side wall portion 58 projecting downwardly at a location beyond both the exhaust inlet means and the outer boundary of the receiving zone for the pushed coke. Further, there is included an essentially vertical partition wall means 54 disposed between the face 12 of the battery 10 and the outer enclosure side wall 58 at a location at least as far removed from the coke-side face of the battery as the outer boundary of the normal receiving zone for the pushed coke. Moreover, partition wall 54 has its upper edge portion 46 supported in spaced relation to the roof enclosure 28, 34 to provide a longitudinal throat 48 at the near side of the exhaust duct inlet means. Finally, a longitudinally extending included bottom wall 60 projects angularly downwardly from side wall 58 to a position adjacent and spaced below the lower edge portion 50 of partition wall 54.

It will be appreciated from the foregoing that there is provided enclosure and exhaust apparatus for enhancing control and removal of coke side emissions during a push in the operations of a coke oven battery. The gaseous and entrained particulate emissions are initially confined to a first longitudinally extending containment or entrapment zone 66 where the emissions are directed, under the influence of its gaseous thermal drive, upwardly and laterally outwardly (in the direction of the arrows shown in FIG. 2) away from the coke-side face of the battery. The emissions are then transferred, at the peak of the first containment zone, laterally, through a gas expansion throat 48, into a second longitudinally extending containment or expansion zone 52. Contemporaneously with entering the second containment zone, a portion of the emissions is removed therefrom through an exhaust conduit 62 located at the upper reaches or peak portion of the second containment zone. The remainder of the gaseous emissions, not immediately removed, are permitted to expand longitudinally and transversely within the second containment zone while carrying with it entrained particulates that also have not been removed through the exhaust system. Finally, the retained remainder of the gaseous emissions in the second containment zone are removed through the exhaust conduit while permitting those particulates that are heavy enough, to fall, by gravity, to a sloped bottom 60 of the second containment zone and, thence, to be discharged to ground at a convenient collection area.

Although the present invention has been shown and described in connection with a particular embodiment thereof, it will be understood that it may otherwise be embodied within the scope of the following claims.

What is claimed is:

1. A method of capturing and controllably removing particulate and gaseous emissions that evolve from hot coke as it is pushed from a coke oven in the operation of a coke battery, which comprises, initially confining said emissions to a first longitudinally extending containment zone having an inclined roof enclosure means projecting angularly upwardly and outwardly from a coke-side face of said battery to be terminally superimposed in spaced relation over an essentially vertical partition wall to form a peak in said first containment zone, while directing said emissions under the influence of its gaseous thermal drive upwardly and laterally outwardly away from the coke-side face of said battery, transferring said emissions, at the peak of said first containment zone, laterally, through a gas expansion throat, into a second longitudinally extending containment zone that is adjacent and parallel to said first containment zone and which has an outer enclosure means including a longitudinally extending side wall portion extending downwardly and a longitudinally extended inclined wall projecting angularly downwardly and inwardly from said side wall to a position adjacent and spaced below the essentially vertical partition wall, contemporaneously removing a portion of said emissions from the upper reaches of said second containment zone through an exhaust conduit superimposed over said second containment zone, permitting the remainder of said gaseous emissions in said second containment zone to expand longitudinally and transversely within said second zone, and removing said remainder of said gaseous emissions from said second containment zone through said exhaust conduit.

2. The method of claim 1 which includes restricting the flow of emissions to said throat to thereby maintain gas velocity.

* * * * *